US009815034B2

(12) United States Patent
Moroz et al.

(10) Patent No.: US 9,815,034 B2
(45) Date of Patent: Nov. 14, 2017

(54) METHOD FOR EMULSION TREATMENT

(71) Applicant: egm-Holding-international GmbH, Papenburg (DE)

(72) Inventors: Vladimier Moroz, Novotscherkassk (RU); Wilhelm Cosov, Chisinau (MD); Wolfgang Gesen, Papenburg (DE); Timo Gesen, Papenburg (DE); Viktor Klauser, Papenburg (DE); Andre Linow, Rastede (DE)

(73) Assignee: egm-Holding-international GmbH, Papenburg (DE)

( * ) Notice: Subject to any disclaimer, the term of this patent is extended or adjusted under 35 U.S.C. 154(b) by 11 days.

(21) Appl. No.: 14/395,561

(22) PCT Filed: Apr. 18, 2013

(86) PCT No.: PCT/EP2013/058060

§ 371 (c)(1),
(2) Date: Oct. 20, 2014

(87) PCT Pub. No.: WO2013/156556

PCT Pub. Date: Oct. 24, 2013

(65) Prior Publication Data

US 2015/0071026 A1 Mar. 12, 2015

(30) Foreign Application Priority Data

Apr. 18, 2012 (DE) ..... 10 2012 206 399

(51) Int. Cl.
*B01F 5/08* (2006.01)
*B01F 5/12* (2006.01)
(Continued)

(52) U.S. Cl.
CPC ..... *B01F 5/0605* (2013.01); *B01F 3/0807* (2013.01); *B01F 3/0811* (2013.01);
(Continued)

(58) Field of Classification Search
CPC .... B01F 5/0614; B01F 5/0657; B01F 5/0688; B01F 5/0696; B01F 5/08; B01F 5/12; B01F 5/16
(Continued)

(56) References Cited

U.S. PATENT DOCUMENTS 3,164,375 A * 1/1965 Frenkel ..... A21C 1/065 241/159
3,486,740 A * 12/1969 Christian ..... B01F 15/068 165/87
(Continued)

FOREIGN PATENT DOCUMENTS

DE 25 05 490 8/1975
DE 20 2005 015 341 U1 2/2006
(Continued)

OTHER PUBLICATIONS

D4a: Feb. 22-23, 2012 Dubai EGM Presentation A with video, Presenting JET EC0121, "Fueling the Future of Aviation," Green Aviation & Logistics Conference, EGM World, Feb. 22-23, 2012, 10 pp.
(Continued)

*Primary Examiner* — Tony G Soohoo
(74) *Attorney, Agent, or Firm* — Muirhead and Saturnelli, LLC

(57) ABSTRACT

A method for producing a single-phase phase-stable liquid is provided, in which, in an embodiment: in a first step, a lipophilic liquid is mixed with a hydrophilic liquid, so that a mixture of the liquids is obtained; in a second step, the static pressure of the mixture is brought below the vapor pressure of at least one of the liquids, so that cavitation bubbles occur, for example, as a result of what is known as
(Continued)

hard cavitation; and in a third step, the cavitation bubbles are caused to implode, a single-phase phase-stable liquid being obtained.

12 Claims, 2 Drawing Sheets

(51) Int. Cl.
*B01F 5/06* (2006.01)
*B01F 3/08* (2006.01)
*B01F 3/10* (2006.01)
*B01F 5/16* (2006.01)
*B01F 13/10* (2006.01)

(52) U.S. Cl.
CPC ..... *B01F 5/0614* (2013.01); *B01F 5/0657* (2013.01); *B01F 5/0688* (2013.01); *B01F 5/0696* (2013.01); *B01F 5/08* (2013.01); *B01F 5/12* (2013.01); *B01F 5/16* (2013.01); *B01F 13/1027* (2013.01); *B01F 2003/0842* (2013.01); *B01F 2003/0849* (2013.01)

(58) Field of Classification Search
USPC ..... 366/165.4, 339, 341
See application file for complete search history.

(56) References Cited

U.S. PATENT DOCUMENTS 3,647,187 A * 3/1972 Dannewitz ..... G01N 35/08 138/42
3,762,947 A * 10/1973 Ornstein ..... B01D 9/0013 127/15
3,937,445 A 2/1976 Agosta
4,111,402 A * 9/1978 Barbini ..... B01F 3/10 138/38
4,127,332 A 11/1978 Thiruvengadam et al.
4,194,844 A * 3/1980 Walling ..... B01F 3/18 198/548
4,410,281 A * 10/1983 Crookes ..... B01F 5/0646 138/178
4,422,773 A * 12/1983 Cassaday ..... B01F 5/0646 366/341
4,884,894 A * 12/1989 Hashimoto ..... B01F 5/0656 366/338
6,112,768 A * 9/2000 Rath ..... B01F 5/0667 138/39
7,045,060 B1 * 5/2006 Liles ..... B01F 3/0861 210/199
7,264,394 B1 * 9/2007 Liles ..... B01F 5/0646 366/339
7,841,762 B2 11/2010 Oogawara et al.
8,088,273 B2 1/2012 Kurata
2007/0014188 A1 * 1/2007 Cymbalisty ..... B01F 5/0646 366/336
2007/0041266 A1 2/2007 Huymann
2007/0241060 A1 * 10/2007 Kolb ..... B01F 5/0646 366/176.1
2008/0267006 A1 * 10/2008 Moreira Campos .. B01F 3/0446 366/165.1
2008/0316858 A1 * 12/2008 Gron ..... B01F 5/061 366/341
2009/0122637 A1 * 5/2009 Kruyer ..... B01F 5/0647 366/167.1
2009/0235850 A1 * 9/2009 Caro ..... B01F 5/0646 110/346
2011/0182134 A1 * 7/2011 Pollard ..... B01F 5/0451 366/172.2
2013/0176815 A1 * 7/2013 Lilja ..... B01D 11/0457 366/318

FOREIGN PATENT DOCUMENTS

DE 10 2006 011 881 A1 9/2007
DE 10 2008 046 889 A1 4/2010
DE 10 2005 037 026 B4 12/2010
DE 20 2011 104 310 U1 1/2012
EP 2 025 392 B1 2/2009
JP 50-14275 A 11/1975
JP 2000-176266 A 6/2000
RU 66221 U1 9/2007
RU 2172207 C1 11/2013
SU 1699564 A1 12/1991
WO WO 2004/004881 1/2004

OTHER PUBLICATIONS

D4b: Feb. 22-23, 2012 Dubai EGM Presentation B with scheme, Presentation on "EGM Bounding System Technology for Production of Eco Jet Fuel," Green Aviation Conference, Feb. 22-23, 2012, 12 pp.
Green Aviation & Logistics Conference 2012, Feb. 2012, Brochure, http://www.goumbook.com/wp-content/uploads/2012/02/Green-Aviation-Logistics-ConferenceC-Brouchure.pdf, Feb. 22-23, 2012, 2 pp.

* cited by examiner

METHOD FOR EMULSION TREATMENT

TECHNICAL FIELD

This application relates to a method for producing a single-phase phase-stable liquid.

BACKGROUND OF THE INVENTION

On the one hand, hyperbolic funnels are known, for example from DE 10 2008 046 889, in order to set liquids in rapid rotational motion.

Furthermore, it is known, for example from U.S. Pat. No. 8,088,273 (column 5, lines 30 ff.), that hard cavitation of emulsions may lead to fundamental chemical changes.

It has hitherto not been possible, in practice, to produce phase-stable liquids from a lipophilic phase and a hydrophilic phase without emulsifiers.

Accordingly, it would be desirable to provide a method for the production of single-phase phase-stable liquids from a lipophilic phase and a hydrophilic phase.

SUMMARY OF THE INVENTION

In a first embodiment, according to the system described herein, a method for producing a single-phase phase-stable liquid is provided, in which:

a. in a first step, a lipophilic liquid is mixed with a hydrophilic liquid, so that a mixture of the liquids is obtained, b. in a second step, the static pressure of the mixture is brought below the vapor pressure of at least one of the liquids, so that cavitation bubbles occur, for example, as a result of what is known as hard cavitation, and c. in a third step, the cavitation bubbles are caused to implode, a single-phase phase-stable liquid being obtained.

In the method according to the system described herein, the lowering of the static pressure in the second step may be brought about by the outlet of the mixture from a nozzle. As a result of the abrupt pressure drop upon exit from the nozzle, cavitation bubbles thus arise as a result of what is known as hard cavitation, since the liquid has a considerable velocity (for example, also due to the rotational motion) when it passes through the nozzle. It is assumed that chemical changes occur at the same time and, in particular, during the subsequent implosion of the cavitation bubbles.

In the method according to the system described herein, the mixture may be set in rotational motion before the second step.

In the method according to the system described herein, the rotational motion of the mixture may be generated by a worm with a helical tube, a hyperbolic funnel, a centrifugal pump, a tube having internal swirl-generating shapes, a turbine or by a plurality of these devices.

For example, the tube of the worm may taper. In the method according to the system described herein, the tapering tube of the worm may widen again in the throughflow direction toward the end of the worm, in which case however, the outlet orifice of the worm may be smaller than the inlet orifice. Alternatively, the tube diameter may also be constant.

In the method according to the system described herein, a convergent and, in particular, convergent/divergent nozzle may be used.

In the method according to the system described herein, the mixture may be first set in rotational motion by means of a centrifugal pump and, for example, the mixture may be subsequently accelerated further in the worm. In particular, the mixture may be subsequently conducted through the tube having internal swirl-generating shapes.

In the method according to the system described herein, the swirl-generating shapes may have at least partially a helicoidal form. The tube may be arranged vertically. A vortex similar to a Taylor-Couette type can thereby be generated. The inside diameter of the tube may lie advantageously in a range of 2 to 10 cm. The length of the tube may lie advantageously in a range of 1 to 3 m.

In the method according to the system described herein, the tube of the worm has may have at its smallest diameter a diameter of at most 30% of the diameter of the inlet.

In the method according to the system described herein, the liquid may surround the outlet of the nozzle. In particular, in an embodiment, the outlet of the nozzle is not arranged in gaseous surroundings.

After the third step c, the single-phase phase-stable liquid may be transferred to a reservoir.

The hydrophilic liquid may be water. The lipophilic liquid may be a fossil fuel, in particular diesel or kerosene.

The weight ratio between the hydrophilic liquid and lipophilic liquid may lie advantageously in a range of 0.8:1 to 1.2:1.

The method according to the system described herein may be carried out at room temperature and at atmospheric ambient pressure.

The first step a. is carried out, for example, at least partially in a charging funnel. In this charging funnel, for example, a retaining device, such as a retaining screen, is arranged at the narrow end of the funnel. Above this retaining device, for example, balls are arranged in the funnel. These balls may have, for example, a diameter in a range of 5 to 20 mm. These balls may be made, for example, from metal and, in particular, from high-grade steel. These balls have the function that the two liquids are already fully intermixed simply as a result of the charging operation.

The inner wall of the worm may, for example, be metallic and, in particular, may be made from copper.

In order to optimize the throughput through the worm, a plurality of tubes and, in particular, two to three tubes may be arranged parallel to one another in a worm-like manner.

BRIEF DESCRIPTION OF THE DRAWINGS

Embodiments of the system described herein will be described in more detail below on the basis of the figures, which are briefly described as follows.

DETAILED DESCRIPTION OF VARIOUS EMBODIMENTS

Figure 1:
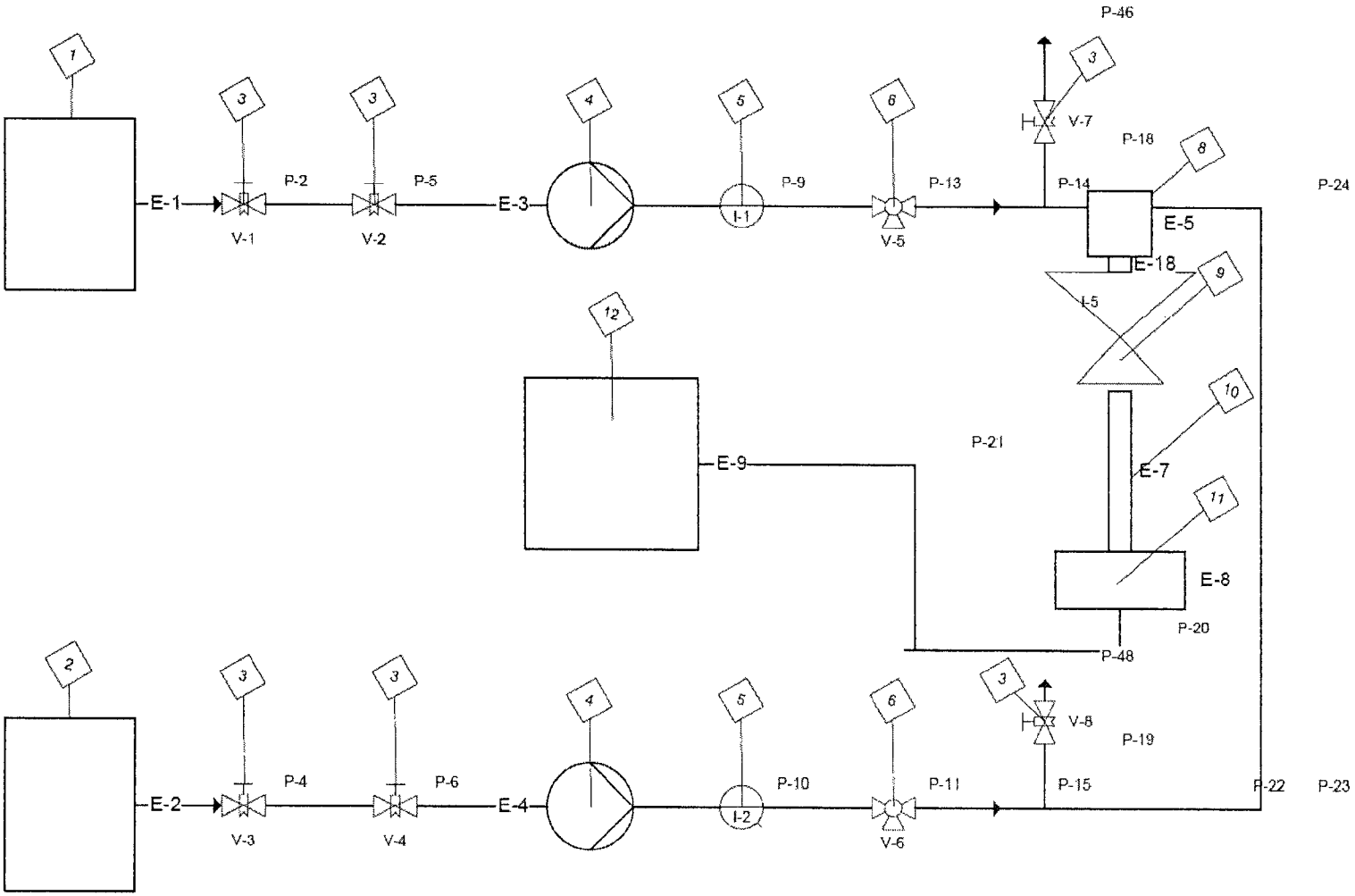
FIG. 1 shows a test set-up for the method according to an embodiment of the system described herein.

FIG. 1 shows a typical test set-up for the method according to an embodiment of the system described herein. The following concrete description of the exemplary embodiment does not restrict the scope of protection and is intended merely to illustrate the system described herein by way of example.

Commercially available kerosene and water were transferred in the weight ratio 1:1 under pressure via conventional delivery systems, and by way of centrifugal pump assemblies, out of the tanks 1 and 2 into a mixing chamber 8 which was configured like a vertically arranged funnel with high-grade steel balls located in it and having a diameter of 11 mm in each case. The high-grade steel balls were retained in the funnel via a retaining screen. As a result of the pressure and the balls, the liquids were emulsified with one another. Subsequently, the emulsion was conducted into a copper tube worm 9 having a uniform tube diameter of 2 cm, the tube being designed like a tapering helix which widens again toward the end of the worm. The worm 9 had an overall diameter of 20 cm at the upper end and a diameter of 5 cm at the smallest diameter. The worm 9 had at the outlet a diameter of 10 cm. Downstream of the worm 9, the emulsion was pressed through a vertically arranged tube 10 with a diameter of 7 cm and a length of 1.5 m and with a helicoidal worm-like deflecting device arranged therein (as in the case of a worm extruder in the sector of plastics technology). Thereafter, the liquid was pressed through nozzles into a container 11 having liquid. The abrupt pressure difference upon exit from the nozzles and the high velocity of the liquid (also the rotational speed) resulted in cavitation. Cavitation bubbles arose which subsequently imploded again immediately. This gave rise to a single-phase phase-stable liquid which obviously no longer contained any water and which had a very good calorific value. The liquid was subsequently transferred into a product container 12.

The calorific value of the kerosene used lay at 43.596 kJ/kg. The calorific value of the liquid obtained lay at 43.343 kJ/kg.

Figure 2:
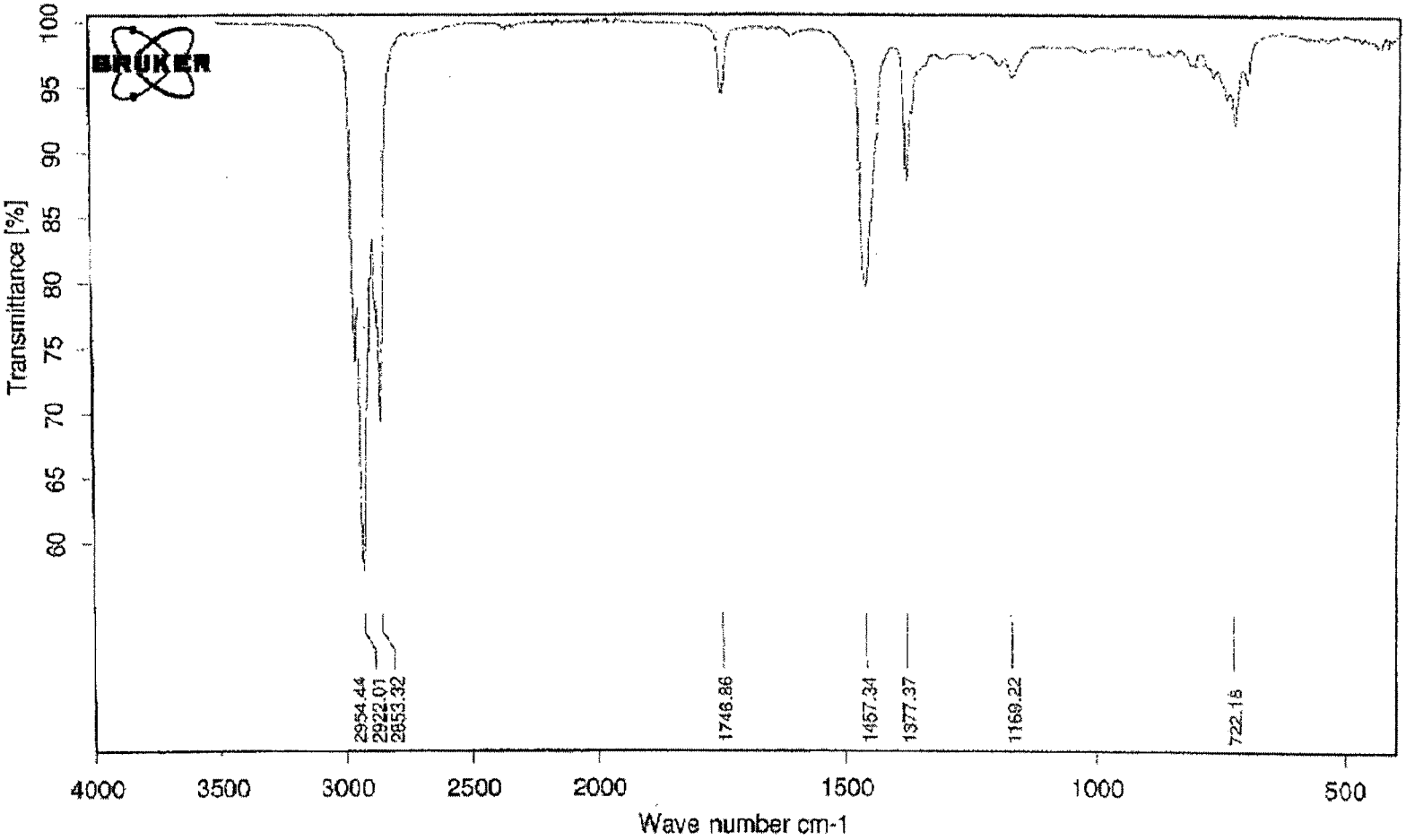
FIG. 2 shows infrared spectroscopy results according to an embodiment of the system described herein.

In the liquid obtained, no sign of water could be found by infrared spectroscopy (FIG. 2). The characteristic broad OH bands at about 3300 to 3400 $cm^{-1}$ were absent.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A method for producing a single-phase phase-stable liquid, comprising:

in a first step, mixing a lipophilic liquid with a hydrophilic liquid, so that a mixture of the liquids is obtained, wherein the mixture is set in rotational motion by a worm with a tapering tube having a helical shape;

in a second step, lowering the static pressure of the mixture below a vapor pressure of at least one of the liquids, so that cavitation bubbles occur; and in a third step, causing the cavitation bubbles are caused to implode, a single-phase phase-stable liquid being obtained.

2. The method according to claim 1, wherein the lowering of the static pressure in the second step is brought about by an outlet of the mixture from a nozzle.

3. The method according to claim 1, wherein the tapering tube of the worm widens again in a throughflow direction toward an end of the worm.

4. The method according to claim 3, wherein an outlet orifice of the worm is smaller than an inlet orifice.

5. The method according to claim 2, wherein the nozzle includes a convergent nozzle.

6. The method according to claim 2, wherein the nozzle includes a convergent/divergent nozzle.

7. The method according to claim 1, wherein the mixture is first set in rotational motion using the centrifugal pump, and wherein the mixture is subsequently accelerated further in the worm.

8. The method according to claim 7, wherein the mixture is subsequently conducted through the tube having internal swirl-generating shapes.

9. The method according to claim 1, wherein the tube of the worm has at a smallest diameter a diameter of at most 30% of a diameter of an inlet.

10. The method according to claim 2, wherein the liquid surrounds the outlet of the nozzle.

11. The method according to claim 1, wherein the tapering tube of the worm widens again in a throughflow direction toward an end of the worm, wherein an outlet orifice of the worm is smaller than an inlet orifice of the worm, and wherein the tube of the worm has at a smallest diameter a diameter of at most 30% of a diameter of the inlet orifice.

12. The method according to claim 1, wherein the tube has an inner wall made of copper.

* * * * *